United States Patent [19]

Beiswanger et al.

[11] 3,933,658

[45] Jan. 20, 1976

[54] METALWORKING ADDITIVE AND COMPOSITION

[75] Inventors: John P. G. Beiswanger, Easton; Asadullah Nassry, Bethlehem, both of Pa.

[73] Assignee: GAF Corporation, New York, N.Y.

[22] Filed: Nov. 29, 1974

[21] Appl. No.: 528,466

Related U.S. Application Data

[63] Continuation of Ser. No. 72,871, Sept. 16, 1970, abandoned.

[52] U.S. Cl. ..... 252/31; 72/42; 252/32.5; 252/42.7; 252/45; 252/46.4; 252/46.6; 252/46.7; 252/48.2; 252/49.5

[51] Int. Cl.[2]. C10M 3/06; C10M 1/44; C10M 3/38; C10M 5/24

[58] Field of Search ..... 72/42; 252/31, 32.5, 42.7, 252/45, 46.4, 46.6, 46.7, 48.2, 49.5

[56] References Cited

UNITED STATES PATENTS

| | | | |
|---|---|---|---|
| 2,218,283 | 10/1940 | Fuller | 252/46.7 |
| 2,318,629 | 5/1943 | Prutton | 252/46.6 |
| 3,203,895 | 8/1965 | Latos et al. | 252/32.5 |
| 3,496,104 | 2/1970 | Shimada et al. | 252/49.5 |

FOREIGN PATENTS OR APPLICATIONS

| | | | |
|---|---|---|---|
| 1,121,567 | 7/1968 | United Kingdom | 252/46.6 |

*Primary Examiner*—Delbert E. Gantz
*Assistant Examiner*—I. Vaughn
*Attorney, Agent, or Firm*—Walter C. Kehm; Joshua J. Ward

[57] ABSTRACT

A metalworking composition and an additive for a metalworking composition which imparts extreme pressure, antiwear, and corrosion-inhibiting properties to the metalworking composition. The additive comprises a phosphate ester and a sulphur compound. The composition comprises the additive used in an oil-based vehicle.

23 Claims, No Drawings

METALWORKING ADDITIVE AND COMPOSITION

This is a continuation of application Ser. No. 72,871, filed Sept. 16, 1970 and now abandoned.

This invention relates to metalworking compositions and an additive for such oil-base metalworking and cooling compositions. More particularly, this invention relates to a metalworking additive comprising a phosphate ester having the following formula:

$$[R-(EO)_n]_a-\overset{\overset{\displaystyle O}{\|}}{P}-[OX]_b$$

wherein EO is ethylene oxide; R is selected from the group consisting of linear or branched chain alkyl groups having from 6 to 30 carbon atoms, phenyl, alkylphenyl, wherein the alkyl group has from 1 to 10 carbon atoms, and dialkyl phenyl, wherein the alkyl groups have a total of from 2 to 20 carbon atoms; X is selected from hydrogen, ammonium, amines and metals from groups I-A, I-B, II-A or II-B of the periodic table; n is a number from 0 to 50; *a* is a number from 1 to 3, *b* is a number from 0 to 2, and a plus *b* = 3; and a sulphur-containing compound. This invention also provides a metalworking composition comprising the above additive in a suitable oil-based vehicle. This invention provides an additive which is used in compositions for cooling and lubricating surfaces which are in frictional contact such as those employed in metalworking operations, such as turning, cutting, drilling, grinding and the like.

Lubricants which have been previously employed in metalworking operations are of two main types, the mineral oils and the so-called soluble oils, which are oil and water emulsions prepared from hydrocarbon oils, water and an emulsifying agent. These prior art lubricants have had many drawbacks, such as inflammability, operability only at certain cutting speeds, rusting, poor extreme pressure properties, etc. Although certain of these prior art lubricant compositions do not have one or more of these undesirable properties, there are no known lubricant compositions which have all the desirable properties of the various prior art lubricating compositions without their corresponding disadvantages and drawbacks.

Briefly, it is found that metalworking lubricant compositions containing the additive of the present invention have excellent extreme pressure antiwear and corrosion-inhibiting properties. Metalworking emulsions containing the additive of this invention also are not inflammable and are extremely stable.

It is therefore a primary object of this invention to provide an additive for lubricant cooling compositions which imparts excellent extreme pressure, antiwear, corrosion-inhibiting and non-inflammable properties to the metalworking composition.

It is a further object of this invention to provide a metalworking additive which gives the metalworking composition a low foam profile.

It is a still further object of this invention to provide a metalworking additive comprising a phosphate ester and a sulphur-containing compound.

It is a still further object of this invention to provide an extreme pressure and antiwear metalworking composition which is non-inflammable, low foaming and corrosion resistant.

Still further objects and advantages of the composition of the present invention will become more apparent from the following more detailed description thereof.

In accordance with this invention, it has been found that a metalworking additive comprising a phosphate ester and a sulphur-containing compound unexpectedly gives metalworking compositions excellent extreme pressure, antiwear and rust-inhibiting properties. This result was especially unexpected since the phosphate esters and sulphur-containing compound have been used singly in prior metalworking lubricating compositions. These metalworking lubricating compositions had either good extreme pressure properties or antiwear properties, but not both. Compositions containing the phosphate esters or sulphur-containing compounds also required the addition of an anti-rust agent. It is therefore quite unexpected that the combination of a phosphate ester and a sulphur-containing compound in a metalworking composition would produce an extreme pressure, antiwear and corrosion-resistant lubricating composition. As stated above, the composition of this invention contains a phosphate ester having the following formula:

$$[R-(EO)_n]_a-\overset{\overset{\displaystyle O}{\|}}{P}-[OX]_b$$

wherein EO, X, *n*, *a* and *b* have the same meanings as above, and a sulphur-containing compound. Although any of the above phosphate esters are suitable for use in the composition of this invention, those phosphate esters are especially preferred wherein R is selected from linear alkyl having from 6 to 20 carbon atoms, alkylphenyl, wherein the alkyl group has from 1 to 14 carbon atoms, and phenyl; *n* is a number from 0 to 10; X is selected from hydrogen, ammonium, diethanolamine and triethanolamine; and EO, *a* and *b* have the same meanings as above. These compounds may be produced by methods disclosed in U.S. Pat. Nos. 3,004,056 and 3,004,057.

The sulphur-containing compounds used in the composition of this invention include elemental sulphur; sulphurized oils, such as lard oil, sperm oil, cod oil, mineral oil, etc.; 2-mercaptobenzothiazole and derivatives thereof having the following formula:

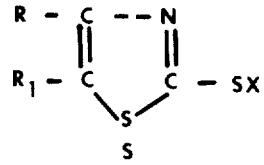

wherein X is selected from hydrogen, hydroxymethyl and metals from Groups I-A, I-B, II-A or II-B of the periodic table; R is selected from hydrogen and an alkyl group having from 1 to 10 carbon atoms; $R_1$ is selected from hydrogen and an alkyl group having from 1 to 10 carbon atoms, carboxy, $$-\overset{\overset{\displaystyle O}{\|}}{C}-CH_3,\quad -\overset{\overset{\displaystyle O}{\|}}{C}-OCH_3,\quad -\overset{\overset{\displaystyle O}{\|}}{C}-OC_2H_5;$$

2-mercaptobenzothiazole and derivatives having the following formula:

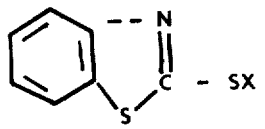

wherein X has the same meaning as above; substituted 2-mercaptothiazole compounds, such as:

5-chloro-2-mercpatobenzothiazole,
5-bromo-2-mercaptobenzothiazole,
5-sulfonic acid (sodium salt)-2-mercaptobenzothiazole,
5-amido-2-mercaptobenzothiazole,
5-methyl-2-mercaptobenzothiazole,
7-methyl-2-mercaptobenzothiazole,
5-carboxylic acid-2-mercaptobenzothiazole,
5-ethoxy-2-mercaptobenzothiazole,
6-ethoxy-2-mercaptobenzothiazole,
6-chloro-2-mercaptobenzothiazole, etc.;

2,2'-dithiobis (thiazole) and derivatives thereof having the following formula:

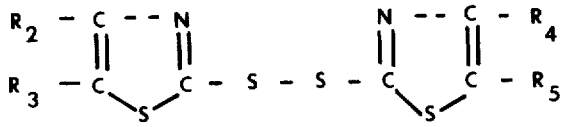

wherein $R_2$, $R_3$, $R_4$ and $R_5$ are selected from hydrogen and an alkyl group having from 1 to 10 carbon atoms; 2,2'-dithiobis (benzothiazole) and derivatives thereof such as 5,5'-dichloro-2,2'dithiobis (benzothiazole), 5,5'-dibromo -2,2'-dithiobis (benzothiazole), 5,5'-disulfonic acid (sodium salt)- 2,2'-dithiobis (benzothiazole), 5,5'-diamido-2,2'-dithiobis (benzothiazole), 5,5'-dimethyl-2,2'-dithiobis (benzothiazole), 7,7'-dimethyl -2,2'-dithiobis (benzothiazole), 5,5'-dicarboxylic acid -2,2'-dithiobis (benzothiazole), 5,5'-diethoxy-2,2'-dithiobis (benzothiazole), 6,6'-diethoxy-2,2'-dithiobis benzothiazole), etc.; polysulfides of the 2-mercaptobenzothiazole compounds listed above; 2-mercaptonapthothiazole; 2,2'-dithiobis (naphthothiazole) and polysulfides of 2-mercaptonaphthothiazole and derivatives of these compounds analogous to the 2-mercaptobenzothiazole derivatives listed above; diphenyl sulfide and analogues such as di-n-butyl sulphide, di-sec-butyl sulphide, di-tert-butyl sulphide, dibenzyl sulphide, etc.; diphenyl disulfide with analogues such as di-n-butyl disulphide, di-sec-butyl disulphide, di-tert-butyl disulphide, dibenzyl disulphide, di-octyl disulphide, di-allyl disulphide, di-n-dodecyl disulphide, etc.; and various sulfones such as di-tert-butyl sulfone.

Although any of the above sulphur-containing compounds may be used in the composition of this invention, 2-mercaptobenzothiazole and its derivatives, elemental sulphur, and the sulphur-containing oils are preferred.

In general, the additive of this invention contains the phosphate ester and sulphur-containing compound in a weight ratio of from 23:1 to 1:1 based on the weight of sulphur in the sulphur-containing compound. The additive of this invention generally comprises less than 10% by weight of the final metalworking composition with the only limitation being the final sulphur content of the composition. The sulphur must comprise at least 0.0015% by weight of the total weight of the metalworking composition. The upper limit is dictated primarily by economics, since a large percentage of the composition of this invention does not appreciably improve the characteristics of the composition. In general, the preferred additive contains a weight ratio of from 10:1 to 1:1 with the sulphur content being at least 0.10% based on the total weight of the composition.

The additive composition of this invention is prepared in the form of an emulsifiable concentrate by mixing the phosphate ester compounds with a portion of a suitable vehicle, such as mineral oils, vegetable oils, animal oils, esters of fatty acids, manufactured oils, cracked hydrocarbons, etc., with stirring to dissolve the phosphate ester. If the phosphate ester is to be neutralized, a neutralizing agent is added at this point. The sulphur-containing compound is dissolved in a suitable non-ionic surfactant, such as the condensation product of a polyglycol ether, or an alkylene oxide such as propylene oxide, butylene oxide or ethylene oxide with an organic compound containing at least 6 carbon atoms and a reactive hydrogen atom, such as alcohols, phenols, thiols, primary and secondary amines, carboxylic and sulfonic acids and their amides, and is added to the phosphate ester-oil mixture. This mixture is then diluted with a suitable oil-based vehicle to provide a metalworking emulsion containing from 1 to 30% of the additive mixture.

If the vehicle used is a sulphur-containing oil such as lard oil, sperm oil, cod oil, etc., a further sulphur-containing compound is not required. In this instance, the metalworking composition would comprise a mixture of the phosphate ester and the sulphur-containing oil.

Since the metalworking compositions of this invention are low foaming and rust-inhibiting, other foam and rust inhibitors are not needed.

The following examples more fully illustrate the additive compositions of this invention and metalworking fluids containing these additives. These examples are for the purpose of illustration only and are not intended to be limiting in any way. In the following examples, all parts and percentages are by weight.

EXAMPLE 1

An emulsifiable metalworking concentrate was prepared by adding 3.00 g of the phosphate ester based on oleyl alcohol plus 4 EO and 17.0 g of a 100 SUS solvent refined naphthenic pale oil into a wide mouth jar. This mixture was stirred at room temperature to dissolve the phosphate ester. 0.70 g of diethanolamine was then added to this mixture, followed by the addition of 14.0 g of a mixture of 1.0 g of 2-mercaptobenzothiazole previously dissolved in 13.0 g of a nonionic surfactant (Igepal CO-430). 65.3 g of 100 SUS solvent refined naphthenic pale oil was then added and this mixture was warmed on a hot plate for 3 to 5 minutes and stirred to effect complete solution of all components. The concentrate was fluid and clear on standing at room temperature.

EXAMPLES 2 TO 6

Using the procedure of Example 1, emulsifiable concentrates having the compositions listed in Table I were prepared.

COMPARATIVE EXAMPLE 1

Following the procedure of Example 1, a concentrate containing no 2-mercaptobenzothiazole was prepared. This concentrate had the following composition:

| | |
|---|---|
| 3.0 g | phosphate ester based on oleyl alcohol plus 4 EO |
| 13.0 g | nonionic (Igepal CO-430) |
| 0.70 g | diethanolamine |
| 83.3 g | 100 SUS solvent refined naphthenic pale oil |

COMPARATIVE EXAMPLE 2

Using the procedure of Example 1, an attempt was made to prepare a concentrate containing no phosphate ester. However, the 2-mercaptobenzothiazole was not soluble in a formulation containing 13.0 g of nonionic (Igepal CO-430) and 86.0 g of 100 SUS oil.

EXAMPLE 7

Seven metalworking emulsions were prepared containing 5% of the concentrates described in Examples 1 through 6 and Comparative Example 1. These emulsions were labelled Emulsions 1 through 6 and CE-1 respectively and had excellent stability, not showing creaming or bottom separation after standing for 24 hours at room temperature. The pH of these emulsions varied from 7.0 to 7.45. These emulsions were then subjected to a rust-inhibiting test, a Shell 4-ball extreme pressure test and a Falex wear test. The results of these tests, which will be more fully described below, are shown in Table II.

The rust-inhibiting properties of these metalworking emulsions were tested by immersing about 10 g of clean cast iron chips in the emulsion for 5 to 10 minutes, after which time the emulsion was drained off and the chips were placed on a clean 1020 carbon steel panel and allowed to stand for 24 hours in the laboratory atmosphere. The results listed in Table II show the percentage rust which formed on the chips immersed in each emulsion. As can be readily seen from the results listed in Table II, those formulations which were prepared from concentrates containing more than 0.50% of 2-mercaptobenzothiazole were effective in inhibiting rust, while those containing either less than 0.50% 2-mercaptobenzothiazole or no 2-mercaptobenzothiazole showed significant amounts of rust forming on these chips. This test clearly shows that the rust-inhibiting properties of these metalworking emulsions are vastly improved by the addition of 2-mercaptobenzothiazole to the phosphate ester containing composition.

The extreme pressure properties of these emulsions were tested by using the Shell 4-ball tester, which is the standard testing device for lubricants. These tests were run at a 100 kg load, 1500 rpm, and room temperature, using 52100 steel balls. The results of the Shell 4-ball test show that by adding the 2-mercaptobenzothiazole to the phosphate ester, the extreme pressure properties of the metalworking emulsion are vastly improved. Even Emulsion 6, which only contained 0.50% of 2-mercaptobenzothiazole, showed vastly improved properties over Comparative Example 1, which contained no 2-mercaptobenzothiazole. These tests clearly showed that metalworking emulsions containing both a phosphate ester and a sulfur-containing compound, in this case 2-mercaptobenzothiazole, have improved extreme pressure properties over compositions containing the phosphate ester alone.

The Falex load tests were run using SAE 3135 steel pins, Rockwell hardness B-87, 8-10 RMS finish and AISI C-1137 steel V blocks, Rockwell C-20 hardness, 6-8 RMS finish. The load was increased in 250-pound increments, running 2 minutes at each 250-pound level until failure occurred either by pin breakage or by failure to maintain torque. The results of this test show that those metalworking emulsions containing both the phosphate ester and the sulphur-containing compound were able to withstand far greater loads than the metalworking emulsion containing only the phosphate ester. In fact, in some cases the load passed using emulsions containing the phosphate ester and the sulphur-containing compound were nearly twice as great as the load passed in Comparative Example 1.

The Falex wear tests were run using the same types of pins and blocks at a load of 1500 pounds. These tests were run on a 1:3 dilution of the 5% emulsions and the results listed are the number of teeth required to maintain the 1500 pound load for fifteen minutes. The fewer teeth required to maintain a load, the less wear is indicated. As is evident from the results in Table II, the emulsions containing the combination of the phosphate ester and more than 0.50% of 2-mercaptobenzothiazole exhibited performance far greater than those emulsions which had 0.50% 2-mercaptobenzothiazole or less. This test shows the importance of maintaining the proper ratio of 2-mercaptobenzothiazole to phosphate ester, since although Emulsion Number 6 contained 2-mercaptobenzothiazole, it did not contain enough to impart excellent wear resistant properties, as evidenced by Emulsions Number 1 and 5.

TABLE I

| PRODUCT | EXAMPLE NO. 2 | 3 | 4 | 5 | 6 |
|---|---|---|---|---|---|
| | Grams Added | | | | |
| Phosphate Ester [1] | 3.0 | 3.5 | 3.5 | 3.0 | 3.0 |
| Nonionic [2] | 13.0 | 13.0 | 13.0 | 13.0 | 13.0 |
| Diethanolamine | 0.70 | 0.75 | 0.75 | 0.70 | 0.70 |
| 2-mercaptobenzothiazole | 1.25 | 1.0 | 1.25 | 0.75 | 0.50 |
| 100 SUS oil | 82.1 | 82.8 | 82.5 | 82.6 | 82.8 |

[1] The phosphate ester based on oleyl alcohol plus 4 EO
[2] Igepal CO-430

TABLE II

| Antiwear and Extreme Pressure Testing | | | | | | | |
|---|---|---|---|---|---|---|---|
| RUNNING TIME, MINUTES | Emulsions 1 through 6, Concentrate 1 | 2 | 3 | 4 | 5 | 6 | CE-1 |
| | Shell 4-Ball Scar Diameters, mm, 5% Emulsion | | | | | | |
| 10 | 0.600 | 0.650 | 0.650 | 0.650 | 0.575 | 0.640 | 1.00 |
| 30 | 0.750 | 0.775 | 0.808 | 0.825 | 0.750 | 0.850 | Weld |
| | Falex Load Test, 5% Emulsion | | | | | | |
| LOAD PASSED, LBS. | 4250 | 4500 | 3750 | 4250 | 3500 | 3500 | 2250 |
| | Falex Wear Test, 1:3 Dilution of 5% Emulsion | | | | | | |
| WEAR, NO. OF TEETH | 0 | 5 | 12 | 0 | 43 | Pin Broke | Pin Broke |

EXAMPLE 8

Four metalworking concentrates as described below in Table III were diluted to form a 5% solution with 1:1 hexylene glycol/water mixture. Shell 4-ball tests were run on these dilute solutions using a 100 kg load, 1500 rpm, 52100 steel balls, at room temperature, and attempts were made to measure the scar diameters after 10 and 30 minutes running time. In Table III, MBT stands for 2-mercaptobenzothiazole, DEA stands for diethanolamine, and phosphate ester stands for the phosphate ester based on oleyl alcohol plus 4 EO. As is evident from the results of Table III, wherein only concentrate 4 containing the 2-mercaptobenzothiazole and the phosphate ester yielded scar diameters, since the other three concentrates welded after from 2 to 9 minutes, a metalworking composition containing both a sulphur derivative and a phosphate ester exhibits vastly improved extreme pressure properties.

EXAMPLE 9

Metalworking concentrates containing the various phosphate esters described in Table IV prepared in a 1:1 mixture of hexylene glycol/water. These concentrates contained 3.0% of the phosphate ester and 1.0% of triethanolamine and were diluted to a 5% solution with 19 parts of a 1:1 mixture of hexylene glycol/water. For each phosphate ester, a concentrate was prepared with 2-mercaptobenzothiazole present in a concentration of 0.50% and without 2-mercaptobenzothiazole (MBT). Shell 4-ball tests were run on these dilutions and scar diameters were measured after 10 and 30 minutes running time at a load of 100 kg, 1500 rpm, and room temperature, using 52100 steel balls. Also one run was made in a hexylene glycol/water solution containing only 0.50% of 2-mercaptobenzothiazole (MBT). The results are listed in Table IV.

TABLE III

| CONCENTRATE NUMBER | % MBT | % DEA | % Phosphate Ester | Scar Diameter, mm. 10 min. | 30 min. |
|---|---|---|---|---|---|
| 1 | 0.50 | | | Weld | |
| 2 | 0.50 | 0.70 | | Weld | |
| 3 | | 0.70 | 3.0 | Weld | |
| 4 | 0.50 | 0.70 | 3.0 | 0.625 | 0.710 |

EXAMPLE 10

An emulsifiable metalworking concentrate was prepared by adding 30 g of phosphate ester based on oleyl alcohol plus 4 EO, 130 g of nonionic surfactant (Igepal CO-430), 6.8 g of diethanolamine, and 10.0 g of the zinc salt of 2-mercaptobenzothiazole. This mixture was heated with stirring to 120°C until a clear solution was obtained. Then 8232 g of 100 SUS solvent refined naphthenic pale oil was added and the mixture was stirred until uniform and allowed to cool to room temperature, giving a clear, stable, emulsifiable concentrate. A 5% emulsion of this concentrate showed no creaming or bottom separation after standing for 24 hours at room temperature. Shell 4-ball tests and Falex load tests were run on the 5% emulsion of this concentrate and a similar concentrate containing no zinc salt of 2-mercaptobenzothiazole. The Falex wear tests were run on a 1:3 dilution of the 5% emulsion. The resulting data are listed in Table V.

TABLE IV

| Antiwear Performance of Various Phosphate Esters with MBT (2-mercaptobenzothiazole) | | | | | |
|---|---|---|---|---|---|
| Phosphate Ester | | Shell 4-Ball Performance Scar Diameter, mm | | | |
| | Moles EO per | WITH MBT | | WITHOUT MBT | |
| Base | Mole of Base | 10 min. | 30 min. | 10 min. | 30 min. |
| Dodecylphenol | 1.8 | 0.645 | 0.825 | 0.613 | Weld |
| Dinonylphenol | 7.0 | 0.846 | 1.00 | 0.754 | Weld |
| Dinonylphenol | 9.6 | 0.833 | 0.900 | 0.733 | Weld |
| Phenol | 6.0 | 0.908 | 0.971 | Weld | |
| Tridecyl alcohol | 3.0 | 0.679 | 0.896 | Weld | |
| No phosphate ester | | Weld | | | |

TABLE V

| Antiwear-EP Performance of a Phosphate Ester Plus the Zinc Salt of 2-Mercaptobenzothiazole | | |
|---|---|---|
| Test | Performance Results | |
| Test | With Zn-MBT | Without Zn-MBT |
| Shell 4-Ball, Scar Dia., mm | With Zn-MBT | Without Zm-MBT |
| 10 min. | 0.600 | 0.950 |
| 30 min. | 0.800 | Weld |
| Falex Load, lbs. | 3250 | 2000 |
| Falex Wear, No. of Teeth | 0 | Pin Broke |

As illustrated by the results shown in Table V, the combination of a phosphate ester and a zinc salt of a sulphur compound produced satisfactory results. The concentration containing both the phosphate ester and the zinc salt was also tested for rust inhibition as described in Example 7. After 24 hours, no rust was observed on chips treated with the metalworking fluid containing both the phosphate ester and the zinc salt of 2-mercaptobenzothiazole, while rusting was observed on the chips immersed in the fluid containing no sulphur-containing compound.

EXAMPLE 11

Concentrates containing no oil were prepared by blending 16.9 g of phosphate ester, 73.4 g of a nonionic surfactant (Igepal CO-430), 4.07 g of diethanolamine, and 5.64 g of either 2-mercaptobenzothiazole or its zinc salt and heating to about 100°– 120°C with stirring. A clear, stable concentrate was formed which was readily dilutable with oil to form an emulsifiable concentrate and yielded metalworking emulsions having properties identical with those previously described.

EXAMPLE 12

An oil-base metalworking fluid was prepared by adding to the base oil 0.50% of the phosphate ester based on oleyl alcohol plus 4 EO and 0.10% elemental sulphur. This fluid was tested as above and gave a Falex load of 4250 pounds, and Shell 4-ball scar diameters of 0.596 mm for at least 10 minutes and 0.693 mm for at least 30 minutes.

A similar fluid was prepared containing only 0.50% of the phosphate ester. This fluid yielded a Falex load of only 1750 pounds and scar diameters of 0.588 mm (10 minutes) and 0.696 mm (30 minutes) were measured. A similar fluid was also prepared containing only 0.10% elemental sulphur. This fluid yielded a Falex load of only 1000 pounds and a scar diameter of greater than 1.0 mm after 10 minutes running time. From these results, it is apparent that the combination of the phosphate ester with the elemental sulphur gave a great improvement in the Falex load carrying capacity of the metalworking fluid.

EXAMPLE 13

An oil-base metalworking fluid was prepared by adding to the oil base 0.50% of the phosphate ester based on oleyl alcohol plus 4 EO and 0.10% dibenzyl disulfide. This oil passed a Falex load of 2250 pounds while the fluid containing only 0.10% dibenzyl disulfide passed a Falex load of only 500 pounds, showing again that improvement was obtained when a combination of a phosphate ester and a sulphur-containing compound was used.

EXAMPLE 14

An emulsifiable metalworking concentrate was prepared by adding 60 g of 100 SUS solvent refined pale oil, 6.7 g of the phosphate ester based on oleyl alcohol plus 4 EO, 10 g of sulphurized sperm oil containing 11.5% sulphur, 10 g of nonionic surfactant (Igepal CO-430) and 13.3 g of nonionic surfactant (Triester of oleyl plus 7 EO).

A similar concentrate was prepared in which the sulphurized sperm oil was omitted and in its place, an additional 10 g of 100 SUS solvent refined pale oil was used. Both these concentrates were clear and stable and 5% emulsions prepared from these concentrates were also stable, showing no creaming or bottom separation in 24 hours standing at room temperature. Shell 4-ball tests and Falex load tests were run on these 5% emulsions and Falex wear tests were run on 1:10 dilutions of the 5% emulsion. The tests were run under the same conditions as those described previously and the results are shown in Table VI below.

EXAMPLE 15

An emulsifiable metalworking concentrate was prepared by adding 7.0 g of 100 SUS solvent refined naphthenic pale oil, 1.0 g of the phosphate ester prepared from oleyl alcohol plus 4 EO, 1.0 g of annonionic emulsifier (Igepal CO-430), and 1.0 g of a sulphurized sperm oil containing 11.5% sulphur to a bottle, warming for 3 to 5 minutes with shaking to give a clear, stable concentrate. A 5% emulsion was prepared by diluting this concentrate with tap water. This emulsion was stable, showing no separation after 24 hours at room temperature. Falex wear tests were run on a 1:10 dilution of this 5% emulsion at a jaw load of 1500 pounds and gave zero teeth wear.

TABLE VI

| Performance of Phosphate Ester with Sulphurized Sperm Oil | | |
|---|---|---|
| | Performance | |
| Test | With Sulphurized Sperm Oil | Without Sulphurized Sperm Oil |
| Shell 4-Ball Scar Diameter, mm | | |
| 10 min. | 0.617 | 0.650 |
| 30 min. | 0.775 | 0.825 |
| Falex Load Load passed, lbs. | 4250 | 4000 |
| Falex Wear No. of Teeth | 18 | 200 |

when a similar formulation was prepared omitting the sulphurized sperm oil, the pin broke after 6 minutes at 1500 pounds in the Falex wear test, demonstrating the superior performance of the combination of products.

EXAMPLE 16

An emulsifiable metalworking concentrate was prepared by adding 6.4 g of a 100 SUS solvent refined naphthenic pale oil, 2.0 g of the phosphate ester based on dinonylphenol plus 9.6 EO, and 1.6 g of a sulphurized sperm oil containing 11.5% sulphur to a bottle. The mixture was warmed slightly and stirred to effect complete solution. A clear, stable concentrate was obtained and a 5% emulsion of this concentrate in tap water was very stable, showing no separation after 24 hours. A Falex wear test was run on a 1:10 dilution of the 5% emulsion. Zero teeth wear was obtained during 15 minutes at a 1500 pound jaw load. A similar formulation, prepared without the sulphurized sperm oil, broke the pin in a Falex wear test after 11 minutes at 1500 pounds.

EXAMPLE 17

An emulsifiable metalworking concentrate was prepared without a phosphate ester present by adding 3.0 g of sulphurized sperm oil, 3.0 g of a petroleum sulfonate (Petromix No. 9), 3.0 g of a nonionic emulsifier (Igepal CO-430) and 21.0 g of a 100 SUS solvent refined naphthenic pale oil to a bottle. The concentrate formed an excellent, stable 5% emulsion. However, in a Falex wear test on a 1:10 dilution of the 5% emulsion, 116 teeth wear were observed in 15 minutes at a jaw load of 1500 pounds. Comparison of the results of this example with those of Examples 15 and 16 demonstrates that both the phosphate ester and sulphur-containing product must be present in the metalworking formulation to obtain excellent antiwear properties.

EXAMPLE 18

A commercially available sulphurized cutting oil containing ¾ to 1% sulphur was evaluated on the Shell 4-ball tester and Falex machine. The balls welded after about 2 minutes at a load of 160 kg, 1500 rpm, using 52100 steel balls in the Shell 4-ball tester. A Falex load of 4250 pounds was attained; the wear was 264 teeth in a Falex wear test at 1000 pounds jaw load. When 0.5% of the phosphate ester prepared from oleyl alcohol plus 4 EO was added to the oil, the Shell 4-ball scar diameters were 0.709 mm after 10 minutes running at 160 kg load and 0.850 mm after 30 minutes. When 1.0% of the same phosphate ester was added, the Falex wear at 1000 pounds was zero teeth; the pin showed no discoloration and was very smooth. Both tests showed, therefore, great improvement in wear performance upon addition of the phosphate ester to the sulphurized oil. Also, when 1.0 % of the phosphate ester and 1.0% of a t-$C_{18}H_{37}NH_2$ to t-$C_{22}H_{45}NH_2$ amine (Primene JMT) were added, the Falex load increased to 4500 pounds and the Falex wear was zero teeth.

EXAMPLE 19

A metalworking oil was formulated by adding 1.0 g of the ammonium salt of the phosphate ester based on oleyl alcohol plus 4 EO to 99.0 g of a sulphurized mineral oil containing ¾ to 1% sulphur. The oil passed 4500 pounds jaw load without failure in the Falex load test, while the oil without the ammonium salt of a phosphate ester failed at 4250 pounds.

EXAMPLE 20

A metalworking oil was formulated by adding 1.0 g of the monoethanolamine salt of the phosphate ester of oleyl alcohol plus 4.0 EO to 99.0 g of a sulphurized mineral oil. The formulated oil passed 4500 pounds jaw load without failure while the oil without the amine salt of the phosphate ester failed at 4250 pounds and developed 10 pounds higher torque.

EXAMPLE 21

Three emulsifiable concentrates were prepared containing the components at the concentrations shown in Table VII.

Emulsions were prepared containing 5% concentrate in 60 ppm tap water and tested for frothing according to Federal Specification VV-C-846a, Method 4.6.3. The emulsion based on Concentrate No. 1 broke in 1.0 minute; the emulsion based on Concentrate No. 2 broke in 0.5 minute; the emulsion based on Concentrate No. 3, containing no 2-mercaptobenzothiazole, broke in 2 minutes.

TABLE VII

| Emulsifiable Concentrates | Concentrate No. | | |
|---|---|---|---|
| Additive | 1 | 2 | 3 |
| Nonionic emulsifier | 13.0 g | 13.0 g | 13.0 g |
| Phosphate ester [1] | 3.0 g | 3.0 g | 3.0 g |
| 2-mercaptobenzothiazole | 0.75 g | 1.25 g | 0.0 g |
| Diethanolamine | 0.72 g | 0.72 g | 0.72 g |
| Oil [2] | 82.5 g | 82.03 g | 83.28 g |

[1] The phosphate ester based on oleyl alcohol plus 4 EO
[2] A 100 SUS solvent refined naphthenic pale oil This shows that composition containing both the phosphate ester and the 2-mercaptobenzothiazole are effective in diminishing emulsion foaming.

EXAMPLE 22

An oil-base metalworking fluid was prepared by adding to a mineral oil 0.50% of the phosphate ester based on oleyl alcohol plus 4.0 EO and 0.10% sulphur. Complete solution was effected by stirring at room temperature. This product gave Shell 4-ball scar diameters of 0.596 and 0.693 mm when tested for 10 and 30 minutes respectively, at 100 kg load at 250 F, using a spindle speed of 1500 rpm, and 52100 steel balls. A Falex load of 4000 pounds was obtained using standard pin and blocks.

When only sulphur was added to the same base oil, the Shell 4-ball scar diameter was greater than 1.00 mm in 10 minutes under the same conditions of test; the Falex load passed was only 750 pounds.

EXAMPLE 23

An oil-base metalworking fluid was prepared by adding to a mineral oil 0.50% of the phosphate ester based on oleyl alcohol plus 4.0 EO and 0.10% dibenzyl disulfide. A Falex load of 2250 pounds was obtained. Mineral oil containing only 0.1% dibenzyl disulfide gave a Falex load of only 500 pounds.

EXAMPLE 24

In the emulsifiable metalworking concentrates of Example 10, the sulphur compound was replaced with:

a. 2-mercaptothiazole;
b. 4,5-dimethyl-2-mercaptothiazole;
c. 5-amido-2-mercaptobenzothiazole;
d. 2,2′-dithiobis (thiazole)
e. 2,2′-dithiobis (benzothiazole)
f. the polysulfide of 2-mercaptobenzothiazole;
g. 2-mercaptonaphthothiazole;
h. diphenyl sulfide; and
i. di-t-butyl sulfone.

Similar results were obtained with each of the above compounds.

As can readily be seen from the foregoing examples, metalworking compositions containing a phosphate ester and a sulphur-containing compound exhibit vastly improved extreme pressure, antiwear, foam-inhibiting and rust-inhibiting properties. While the compositions of this invention have been illustrated by the foregoing examples, the compositions of this invention are to be limited only by the appended claims.

What we claim is:

1. An additive composition for imparting a combination of extreme pressure, antiwear and corrosion-inhibiting properties to a metalworking composition, said additive comprising:

a. a phosphate ester having the following formula:

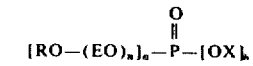

wherein EO is ethylene oxide; R is selected from the group consisting of linear or branched chain alkyl groups having from 6 to 30 carbon atoms, phenyl, alkylphenyl, wherein the alkyl group has from 1 to 10 carbon atoms, and dialkyl phenyl wherein the alkyl groups have a total of from 2 to 20 carbon atoms; X is selected from hydrogen, ammonium, amines and metals from groups I-A, I-B, II-A and II-B of the periodic table; n is a number from 0 to 50; *a* is 1, 2 or 3, and *b* is 0, 1 or 2 with the proviso that said a plus said *b* equals 3; and b. a sulphur-containing compound selected from the group consisting of elemental sulphur; sulphurized mineral oils; 2-mercaptobenzothiazole; 5-substituted, 6-substituted and 7-substituted 2-mercaptobenzothiazole wherein the substituent is selected from the group consisting of chloro, bromo, sulfonic acid, amido, methyl, carboxylic acid, and ethoxy; 2-mercaptobenzothiazole derivatives having the following formula:

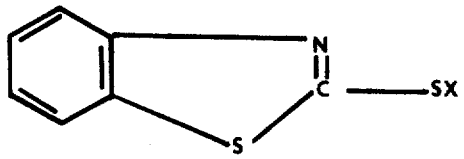

wherein X is selected from hydrogen, hydroxymethyl and metals of groups I-A, I-B, II-A and II-B of the periodic table; derivatives of 2-mercaptothiazole having the formula:

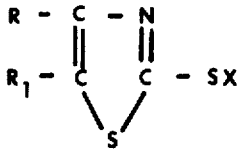

wherein X is selected from hydrogen, hydroxymethyl and metals from groups I-A, I-B, II-A and II-B of the periodic table; R is selected from hydrogen and an alkyl group having from 1 to 10 carbon atoms; and $R_1$ is selected from hydrogen, an alkyl group having from 1 to 10 carbon atoms, carboxy,

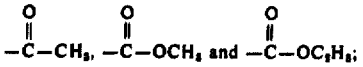

2,2′-dithiobisthiazole and derivatives thereof having the following formula:

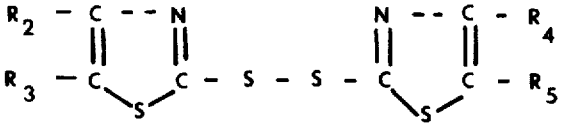

wherein $R_2$, $R_3$, $R_4$ and $R_5$ are selected from the group consisting of hydrogen and an alkyl group having from 1 to 10 carbon atoms; 2,2′-dithiobis(benzothiazole) and 5,5′, 6,6′, and 7,7′ substituted derivatives thereof wherein the substituent is taken from a group consisting of dichloro, dibromo, disulfonic acid, diamido, dimethyl, dicarboxylic acid, and diethoxy; 2-mercaptonaphthiazole; 2,2′-dithiobis (naphthothiazole); diphenyl sulfide; diphenyl disulfide and di-tert-butyl sulfone, the weight ratio of said phosphate ester to said sulphur-containing compound being in a range of from about 25:1 to about 1:1 based on the weight of sulphur in said sulphur-containing comoound, said additive composition containing at least about 0.005% sulphur by weight, based on the total weight of said additive composition.

2. The additive composition of claim 1 wherein the ratio of phosphate ester to sulphur-containing compound is from 10:1 to 1:1 by weight based on the sulphur content of the sulphur-containing compound and wherein R of the formula of (a) is selected from the group consisting of a linear alkyl group having from 6 to 20 carbon atoms, an alkyl phenyl group, the alkyl group having from 1 to 14 carbon atoms, and phenyl; *n* is a number from 1 to 10; and X is selected from hydrogen, ammonium, diethanolamine, and triethanolamine.

3. The composition of claim 2 in which said sulphur-containing compound comprises 2-mercaptobenzothiazole.

4. The composition of claim 2 in which the sulphur-containing compound comprises 5-substituted, 6-substituted and 7-substituted 2-mercaptobenzothiazole wherein the substituent is selected from the group consisting of chloro, bromo, sulfonic acid, amido, methyl, carboxylic acid, and ethoxy.

5. The composition of claim 2 in which the sulphur-containing compound comprises 2-mercaptobenzothiazole derivatives having the following formula:

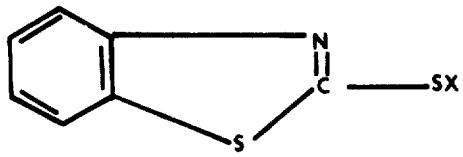

wherein X is selected from hydrogen, hydroxymethyl and metals of groups I-A, I-B, II-A and II-B of the periodic table.

6. The composition of claim 2 in which the sulphur-containing compound comprises 2,2′-dithiobisthiazole and derivatives thereof having the following formula:

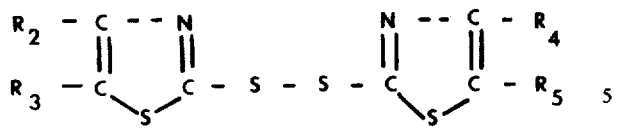

wherein $R_2$, $R_3$, $R_4$ and $R_5$ are selected from the group consisting of hydrogen and an alkyl group having from 1 to 10 carbon atoms.

7. The composition of claim 2 in which the sulphur-containing compound comprises 2,2′-dithiobis(benzothiazole) and 5,5′, 6,6′, and 7,7′ substituted derivatives thereof wherein the substituent is taken from a group consisting of dichloro, dibromo, disulfonic acid, diamido, dimethyl, dicarboxylic acid, and diethoxy.

8. The composition of claim 2 in which the sulphur-containing compound comprises diphenyl sulfide.

9. The composition of claim 2 in which the sulphur-containing compound comprises elemental sulphur.

10. The composition of claim 2 in which the sulphur-containing compound comprises sulphurized mineral oils.

11. An improved metalworking composition comprising:

a. a phosphate ester having the following formula:

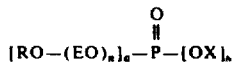

wherein EO is ethylene oxide; R is selected from the group consisting of linear or branched chain alkyl groups having from 6 to 30 carbon atoms, phenyl, alkylphenyl, wherein the alkyl groups have a total of from 2 to 20 carbon atoms; X is selected from hydrogen, ammonium, amines and metals from groups I-A, I-B, II-A and II-B of the periodic table; *n* is a number from 0 - 50; *a* is 1, 2 or 3, and *b* is 0, 1 or 2 with the proviso that said a plus said b equals 3;

b. a sulphur-containing compound selected from the group consisting of elemental sulphur; sulphurized mineral oils; 2-mercaptobenzothiazole; 5-substituted, 6-substituted and 7-substituted 2-mercaptobenzothiazole wherein the substituent is selected from the group consisting of chloro, bromo, sulfonic acid, amido, methyl, carboxylic acid, and ethoxy; 2-mercaptobenzothiazole derivatives having the following formula:

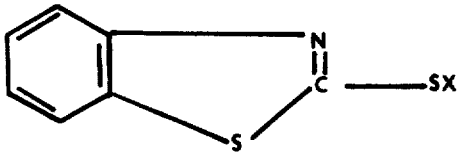

wherein X is selected from hydrogen, hydroxymethyl and metals of groups I-A, I-B, II-A and II-B of the periodic table; derivatives of 2-mercaptothiazole having the formula:

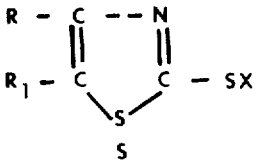

wherein X is selected from hydrogen, hydroxymethyl and metals from groups I-A, I-B, II-A and II-B of the periodic table; R is selected from hydrogen and an alkyl group having from 1 to 10 carbon atoms; and $R_1$ is selected from hydrogen, an alkyl group having from 1 to 10 carbon atoms, carboxy,

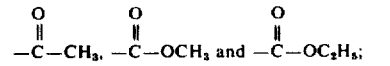

2,2′-dithiobisthiazole and derivatives thereof having the following formula:

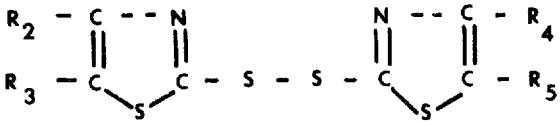

wherein $R_2$, $R_3R_4$ and $R_5$ are selected from the group consisting of hydrogen and an alkyl group having from 1 to 10 carbon atoms, 2,2′-dithiobis(benzothiazole) and 5,5′, 6,6′, and 7,7′ substituted derivatives thereof wherein the substituent is taken from a group consisting of dichloro, dibromo, disulfonic acid, diamido, dimethyl, dicarboxylic acid, and diethoxy; 2-mercaptonaphthothiazole ; 2,2′-dithiobis (naphthothiazole; diphenyl sulfide; diphenyl disulfide and di-tert-butyl sulfone; and c. an oil based lubricating vehicle, the weight ratio of said phosphate ester to said sulphur-containing compound being in the range of from about 25:1 to about 1:1 based on the weight of sulphur in said sulphur-containing compound and said composition containing at least about 0.0015% sulphur by weight, based on the total weight of said metalworking composition, whereby the metalworking composition has a desirable combination of extreme pressure, antiwear and corrosion-inhibiting properties.

12. The metalworking composition of claim 11 wherein the ratio of phosphate ester to sulphur-containing compound is from 10:1 to 1:1 by weight based on the sulphur content of the sulphur-containing compound, wherein R is selected from the group consisting of a linear alkyl group having from 6 to 20 carbon atoms, an alkyl phenyl group, the alkyl group having from 1 to 14 carbon atoms, and phenyl; *n* is a number from 1 to 10; and X is selected from hydrogen, ammonium, diethanolamine, and triethanolamine and in which said composition contains at least about 0.10% sulphur by weight, based on the total weight of said metalworking composition.

13. The metalworking composition of claim 12 wherein said vehicle is selected from the group consisting of a mineral oil, a glycol, a mineral oil-water mixture and a glycol-water mixture.

14. The metalworking composition of claim 13 wherein the vehicle is a hexylene glycol-water mixture.

15. The metalworking composition of claim 12 in which said sulphur-containing compound comprises 2-mercaptobenzothiazole.

16. The metalworking composition of claim 13 in which the sulphur-containing compound comprises 5-substituted, 6-substituted and 7-substituted 2-mercaptobenzothiazole wherein the substituent is selected from the group consisting of chloro, bromo, sulfonic acid, amido, methyl, carboxylic acid, and ethoxy.

17. The metalworking composition of claim 13 in which the sulphur-containing compound comprises 2-mercaptobenzothiazole derivatives having the following formula:

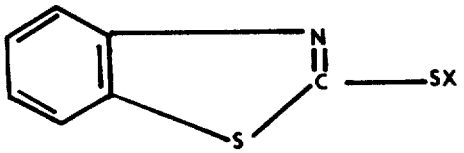

wherein X is selected from hydrogen, hydroxymethyl and metals of groups I-A, I-B, II-A and II-B of the periodic table.

18. The metalworking composition of claim 13 in which the sulphur-containing compound comprises 2,2-dithiobisthiazole and derivatives thereof having the following formula:

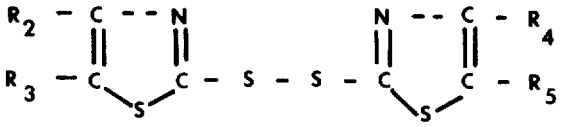

wherein $R_2$, $R_3$, $R_4$ and $R_5$ are selected from the group consisting of hydrogen and an alkyl group having from 1 to 10 carbon atoms.

19. The metalworking composition of claim 13 in which the sulphur-containing compound comprises 2,2′-dithiobis(benzothiazole) and 5,5′, 6,6′ and 7,7′ substituted derivatives thereof wherein the substituent is taken from a group consisting of dichloro, dibromo, disulfonic acid, diamido, dimethyl, dicarboxylic acid, and diethoxy.

20. The metalworking composition of claim 13 in which the sulphur-containing compound comprises diphenyl sulfide.

21. The metalworking composition of claim 13 in which the sulphur-containing compound comprises elemental sulphur.

22. The metalworking composition of claim 13 in which the sulphur-containing compound comprises sulphurized mineral oil.

23. A metalworking process which comprises working metal in the presence of the metalworking composition of claim 13.

* * * * *